US010122133B2

(12) United States Patent
Maesoba

(10) Patent No.: US 10,122,133 B2
(45) Date of Patent: Nov. 6, 2018

(54) COMMUNICATION CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Hiroyoshi Maesoba, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/503,412

(22) PCT Filed: Sep. 3, 2015

(86) PCT No.: PCT/JP2015/075037
§ 371 (c)(1),
(2) Date: Feb. 13, 2017

(87) PCT Pub. No.: WO2016/035844
PCT Pub. Date: Mar. 10, 2016

(65) Prior Publication Data

US 2017/0256894 A1 Sep. 7, 2017

(30) Foreign Application Priority Data

Sep. 4, 2014 (JP) ..... 2014-180348

(51) Int. Cl.
*H01R 13/6473* (2011.01)
*H01R 24/60* (2011.01)
*H01R 107/00* (2006.01)

(52) U.S. Cl.
CPC ..... *H01R 24/60* (2013.01); *H01R 13/6473* (2013.01); *H01R 2107/00* (2013.01)

(58) Field of Classification Search
CPC . H01R 24/60; H01R 13/6473; H01R 13/6585
See application file for complete search history.

(56) References Cited

U.S. PATENT DOCUMENTS 4,781,620 A * 11/1988 Tengler ..... H01R 9/05 29/858
5,197,893 A * 3/1993 Morlion ..... H01R 23/688 439/101

(Continued)

FOREIGN PATENT DOCUMENTS

| | | |
|---|---|---|
| JP | 2004-079377 | 3/2004 |
| JP | 2004-342563 | 12/2004 |
| JP | 2008-507110 | 3/2008 |

OTHER PUBLICATIONS

International Search Report dated Nov. 10, 2015.

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

A communication connector (10) includes a plurality of wires (11A to 11C, 12A, 12B, 13, 14) for transmitting communication signals, a plurality of terminals (20) connected to the respective wires (11A to 11C, 12A, 12B, 13, 14), a housing (30) for accommodating the plurality of terminals (20), and a partition wall portion (40) for partitioning between the plurality of wires (11A to 11C, 12A, 12B, 13, 14).

7 Claims, 30 Drawing Sheets

(56) References Cited

U.S. PATENT DOCUMENTS 5,571,035 A * 11/1996 Ferrill ..... H01R 13/6461 439/676
5,725,387 A * 3/1998 O'Sullivan ..... H01R 4/187 439/98
6,045,389 A * 4/2000 Ferrill ..... H01R 9/031 439/398
6,323,430 B1 * 11/2001 Finona ..... H01R 9/0518 174/135
6,364,701 B1 * 4/2002 O'Sullivan ..... H01R 9/038 439/497
6,482,028 B2 * 11/2002 Kumamoto ..... H01R 13/5808 439/498
6,764,342 B2 * 7/2004 Murayama ..... H01R 4/023 439/108
6,935,870 B2 * 8/2005 Kato ..... H01R 23/688 439/108
6,951,487 B2 * 10/2005 Ozai ..... H01R 9/032 439/637
7,147,512 B2 * 12/2006 Wu ..... H01R 12/721 439/607.05
7,249,962 B2 * 7/2007 Milette ..... H01R 4/2404 439/404
7,758,374 B2 * 7/2010 Yu ..... H01R 4/027 439/493
7,824,198 B2 * 11/2010 Tanaka ..... H01R 9/034 439/108
9,634,446 B2 * 4/2017 Chien ..... H01R 27/02
9,728,866 B2 * 8/2017 Liao ..... H01R 9/223
2003/0064614 A1 * 4/2003 Tanaka ..... H01R 13/65802 439/98
2004/0185705 A1 * 9/2004 Wu ..... H01R 13/5808 439/459
2004/0235360 A1 11/2004 Takahashi
2006/0014431 A1 1/2006 Shuey et al.
2007/0293097 A1 * 12/2007 Martin ..... H01R 13/6467 439/713
2011/0034061 A1 * 2/2011 Wu ..... H01R 13/648 439/345
2015/0050836 A1 * 2/2015 Wu ..... H01R 13/4367 439/607.01
2015/0270659 A1 * 9/2015 Kao ..... H01R 13/2442 439/607.01
2016/0141803 A1 * 5/2016 Hsu ..... H01R 24/60 439/607.55

* cited by examiner

COMMUNICATION CONNECTOR

BACKGROUND

1. Field of the Invention

The present invention relates to a communication connector.

2. Description of the Related Art

Communication connectors are known. For example, Japanese Unexamined Patent Application Publication No. 2008-507110 discloses an electrical connector capable of receiving four USB plug connectors is described in. This electrical connector includes a housing, electrical contacts formed of metal bars bent into an L shape, an outer shield and an inner shield. Electrical contacts are fixed side by side in a lateral direction for each USB plug connector.

Wires may be used as conductors instead of metal bars. However, intervals between the wires may change a large amount in some places since the wires are easily deflected. Such places where the intervals between the wires change may become impedance changing points of the wires and may cause signal reflection to reduce communication quality.

The present invention was completed based on the above situation and aims to suppress a reduction of communication quality.

SUMMARY

The present invention is directed to a communication connector with a plurality of wires for transmitting communication signals, and terminals are connected to the respective wires. A housing accommodates the terminals, and a partition partitions between the wires.

According to this configuration, the partition partitions between the wires. Thus, the number of places where intervals between the wires can change a large amount is reduced and a reduction of communication quality such as due to signal reflection at impedance changing points of the wires can be suppressed.

In one embodiment, the wires include a USB 3.0 first wire and a USB 2.0 second wire, and the partition is arranged between the first wire and the second wire.

In another embodiment, the wires include a USB 3.0 first wire and a power supply wire connected to a power supply, and the partition is arranged between the first wire and the power supply wire.

In still another embodiment, the wires include a plurality of USB 3.0 first wires, and the partition is arranged between the first wires.

Wire rows may be formed by arranging the wires in parallel, and the partition may be arranged between the wire rows.

The partition may include a first wall arranged between the wire rows and second walls standing on the first wall and arranged between the wires in each wire row.

In one embodiment, plural USB 3.0 first wires are provided in each wire row, and the first wires partitioned by the second wall in one wire row are arranged at positions diagonal to first wires in the different wire row.

The partition may be formed by connecting partition plates, and the second wall may stand on the first wall in each partition plate.

The partition may be fixed by being press-fit into the housing.

The housing may include plural cavities for accommodating the respective terminals, and the communication connector may be installed in a vehicle.

According to the present invention, it is possible to suppress a reduction of communication quality.

DETAILED DESCRIPTION

A first embodiment is described with reference to FIGS. 1 to 13. A communication connector 10 is installed in a vehicle, such as an electric vehicle or hybrid vehicle, and is arranged in a wired communication path between an in-vehicle electric component (navigation system, ETC system, monitor, etc.) in the vehicle and an external device (camera, etc.) or between in-vehicle electric components. In the following description, a vertical direction (Y-axis) and a lateral direction (X-axis) are based on directions of FIG. 2, and a left side and a right side of FIG. 4 are referred to as a front side and a rear side concerning a front-rear direction (Z-axis).

Figure 3:
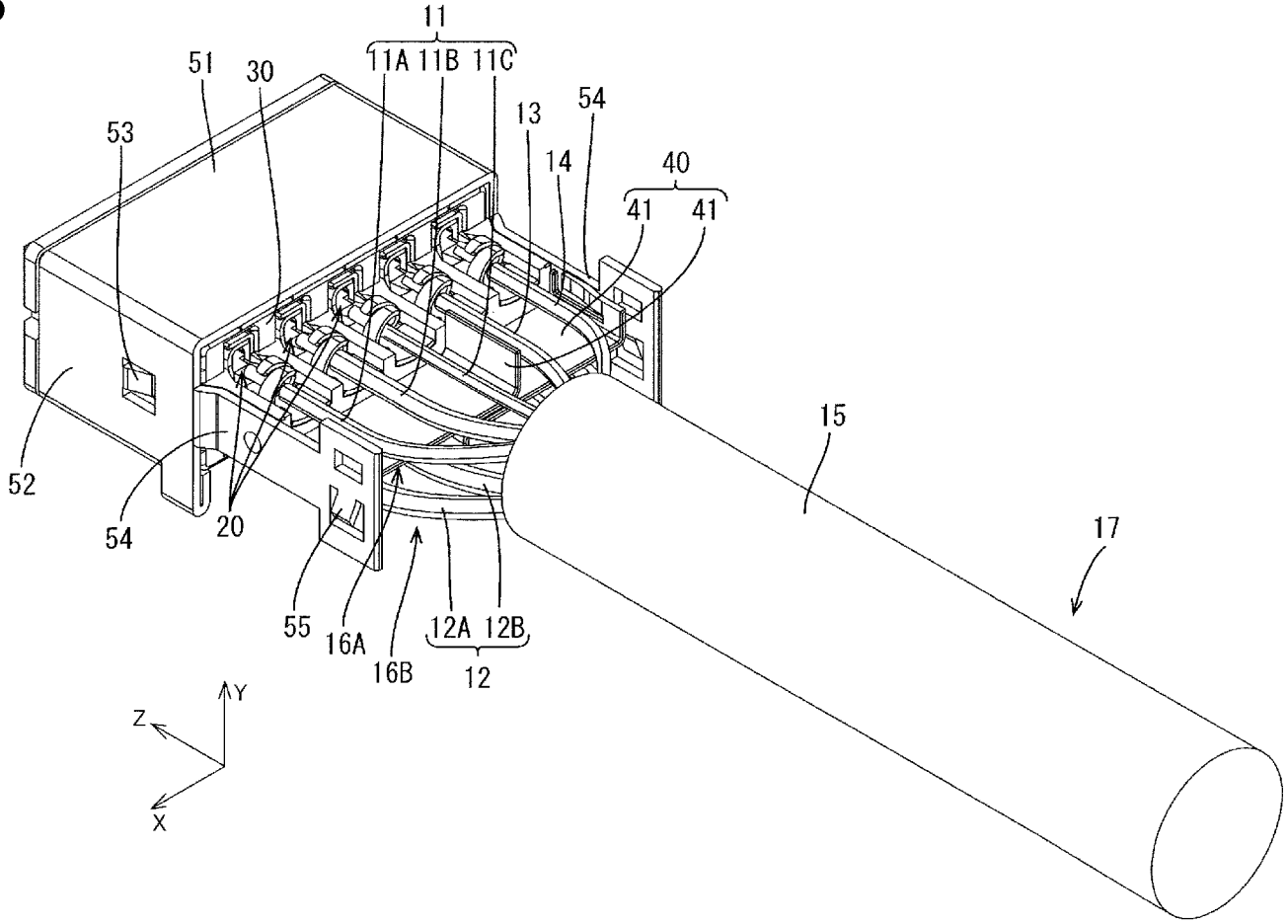
FIG. 3 is a perspective view showing the communication connector in a state where a second shield case is removed.
Figure 4:
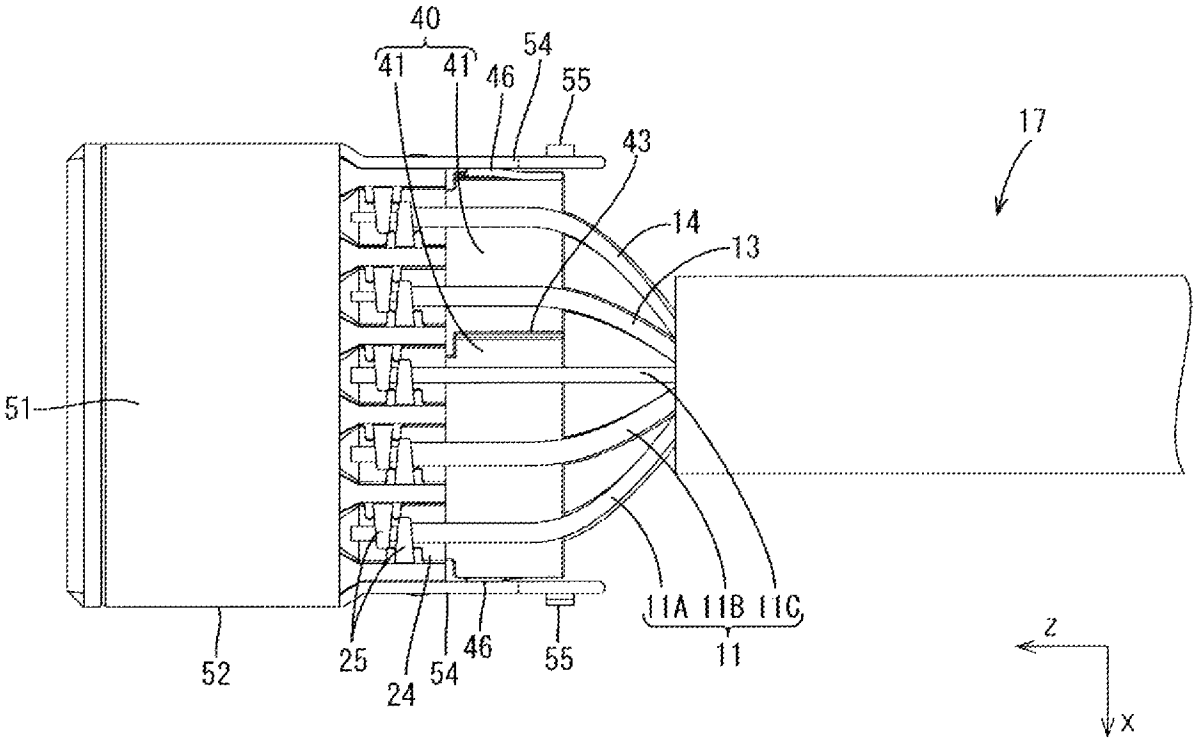
FIG. 4 is a plan view showing the communication connector in the state where the second shield case is removed.

The communication connector 10 of this embodiment includes, as shown in FIG. 3, a shielded cable 17 having a plurality of (ten in this embodiment) wires 11, 12, 13 and 14. The wires 11 are composed of two sets of first wires 11A to 11C, and the wires 12 are composed of one set of second wires 12A, 12B. Terminals 20 are connected to end parts of the respective wires 11 to 14. A housing 30 accommodates the terminals 20, and a partition 40 partitions between the wires 11 to 14 extending rearward of the housing 30. A shield case 50 (see FIG. 1) is provided for covering the housing 30 and the wires 11 to 14.

(Shielded Cable 17)

The shielded cable 17 is capable of communication of USB (Universal Serial Bus) 3.0 standard and includes ten wires 11 to 14. A shield layer (not shown) collectively encloses the ten wires 11 to 14 and is formed of a braided wire formed by braiding thin metal wires. An insulation coating 15 covers the outer periphery of the shield layer and is made of insulating synthetic resin.

(Wires 11 to 14)

The ten wires 11 to 14 include two sets of USB 3.0 wires 11 (differential pair cable with a shield and a drain wire), one set of USB 2.0 wires 12 (twisted pair cable without a shield), a power supply wire 13 connected to a power supply and a ground wire 14 connected to ground.

Each wire 11 to 14 is formed by covering a conductor formed of a metal wire with an insulation coating made of insulating synthetic resin. End parts of the ten wires 11 to 14 extending forward from ends of the shield layer and the insulation coating 15 of the shielded cable 17 have the insulation layers removed to expose conductors to be connected to the terminals 20. Five of the wires 11 to 14 are arranged side by side in a row in each of two separate upper and lower stages to extend toward a tip side, thereby constituting upper and lower wire rows 16A, 16B.

(Terminals 20)

Figure 5:
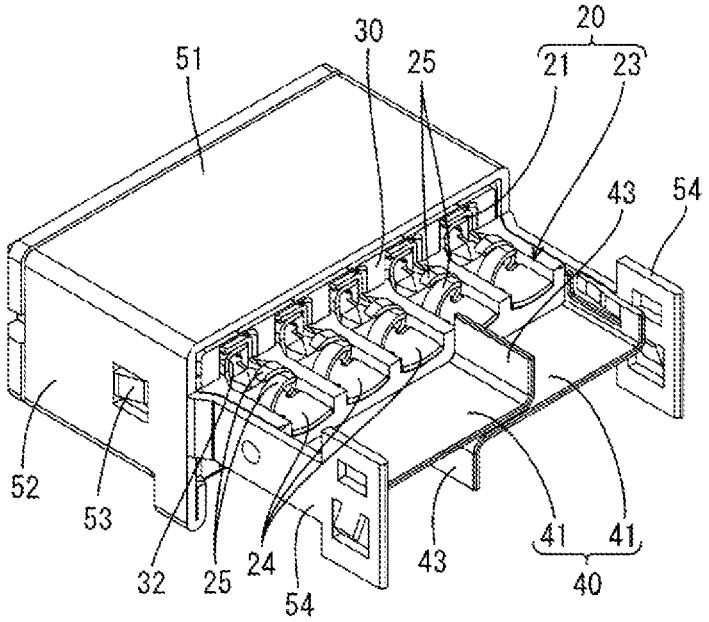
FIG. 5 is a perspective view showing the communication connector in a state where the second shield case and the shielded cable are removed.
Figure 6:
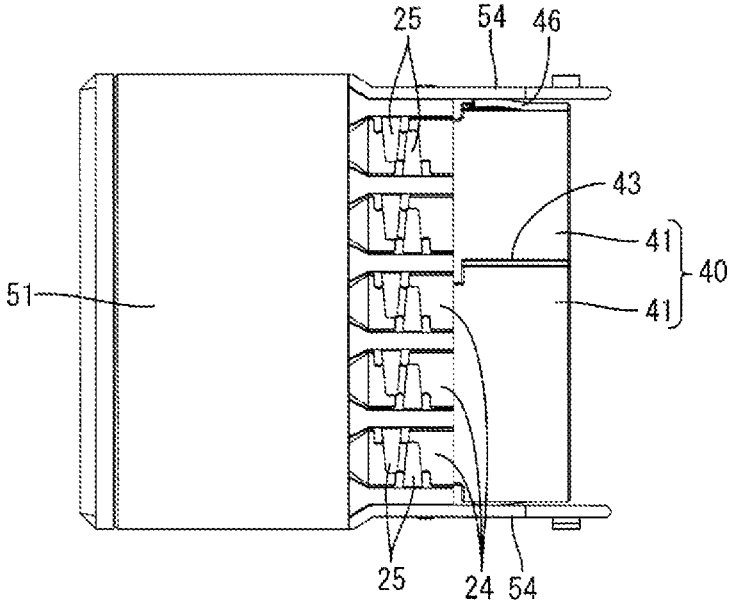
FIG. 6 is a plan view showing the communication connector in the state where the second shield case and the shielded cable are removed.
Figure 7:
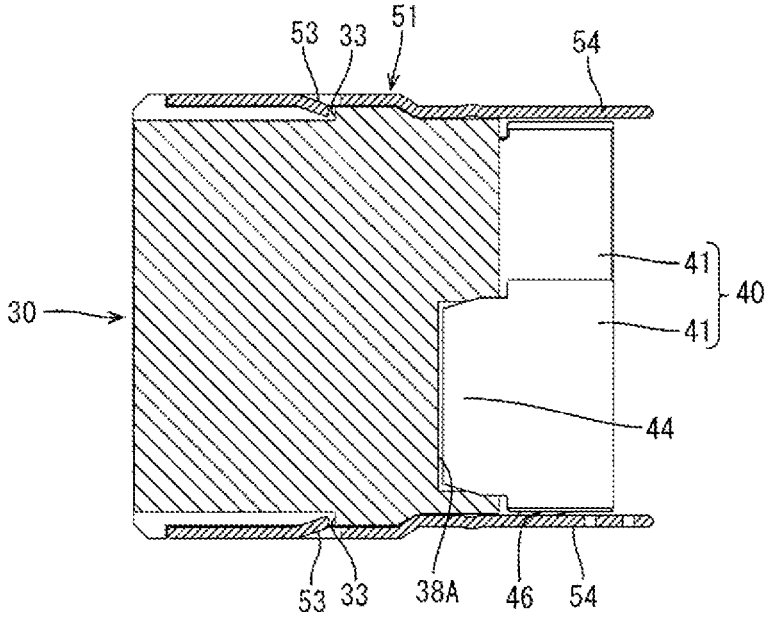
FIG. 7 is a plan view in section at a height of press-fit holes in the state of FIG. 6.
Figure 14:
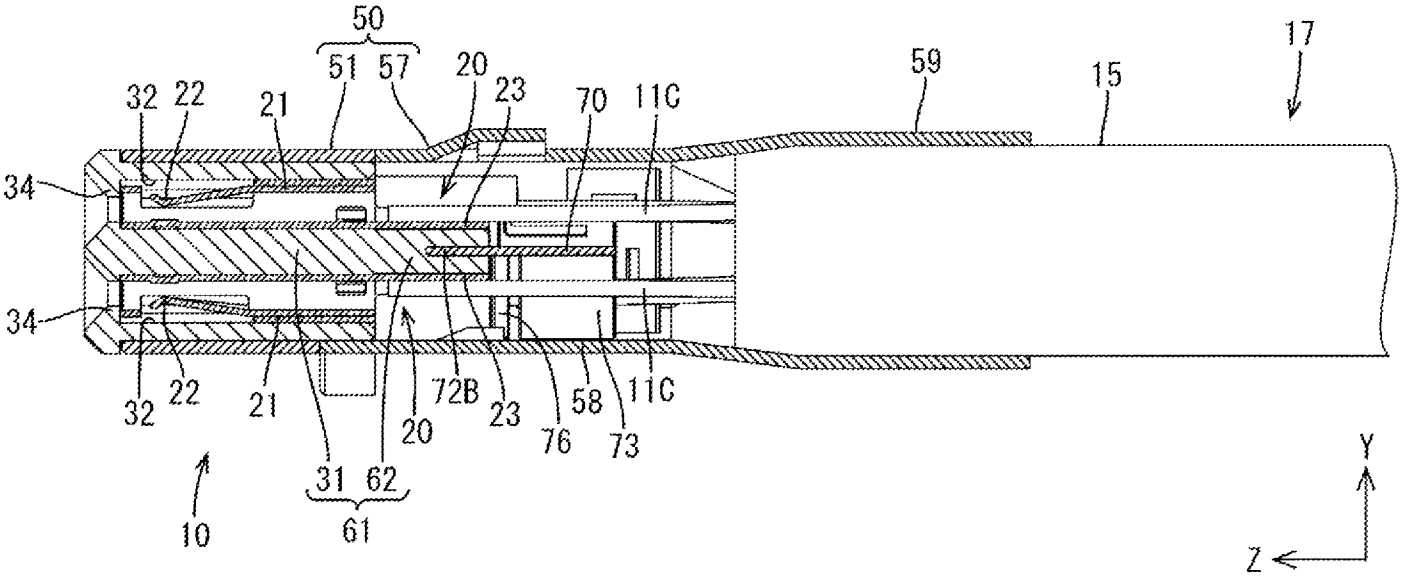
FIG. 14 is a longitudinal section showing a communication connector of a second embodiment connected to an end part of a shielded cable.
Figure 15:
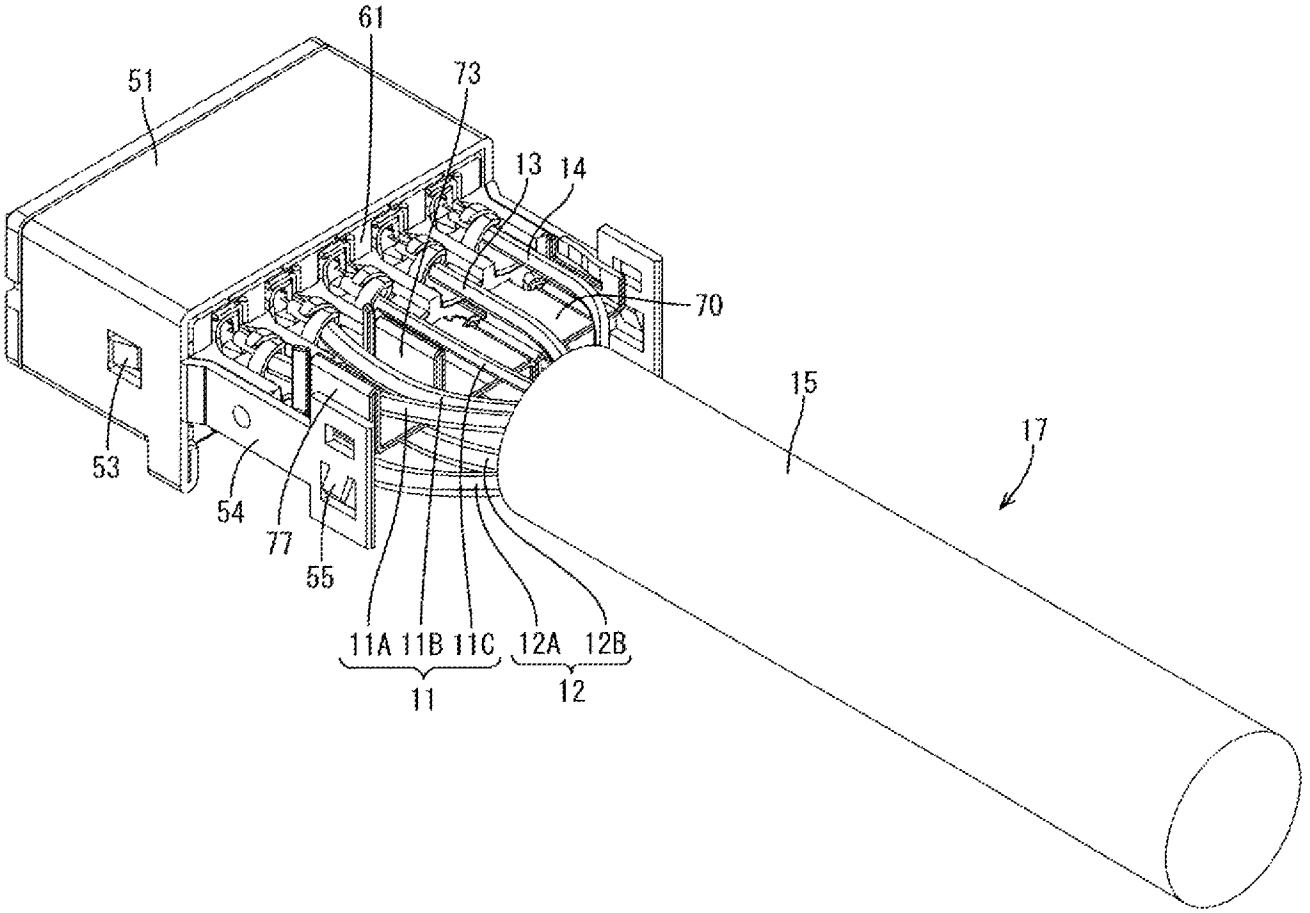
FIG. 15 is a perspective view showing the communication connector connected to the end part of the shielded cable in a state where a second shield case is removed.
Figure 16:
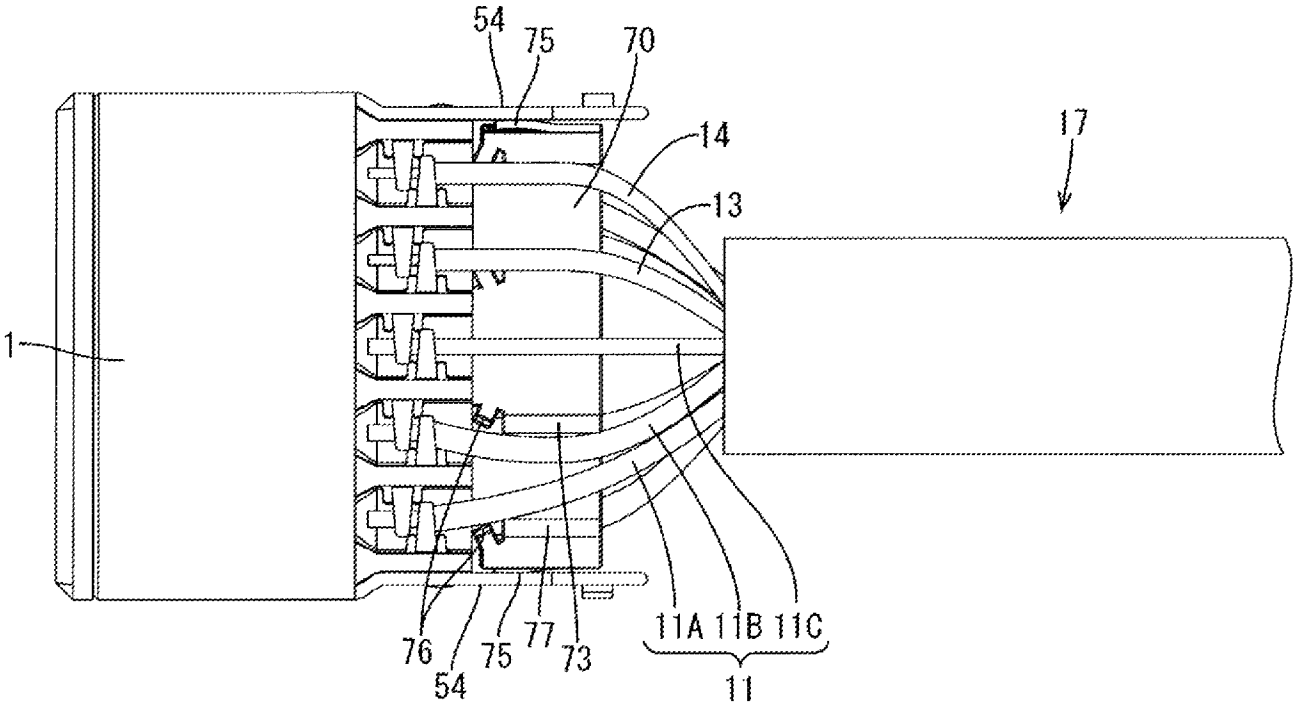
FIG. 16 is a plan view showing the communication connector connected to the end part of the shielded cable in the state where the second shield case is removed.
Figure 17:
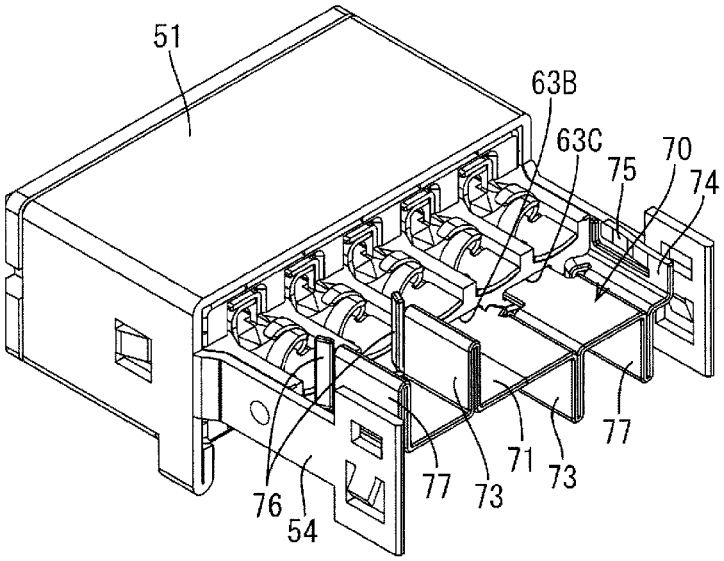
FIG. 17 is a perspective view showing the communication connector in a state where the second shield case and the shielded cable are removed.
Figure 18:
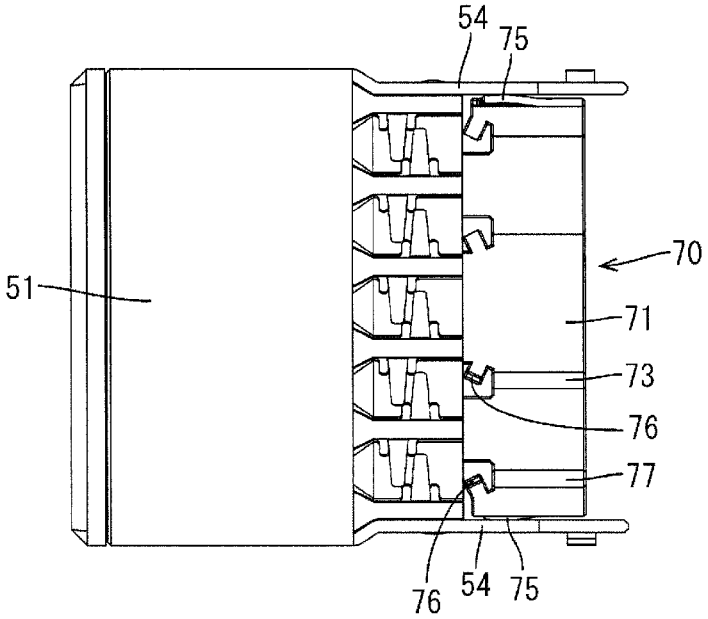
FIG. 18 is a plan view showing the communication connector in the state where the second shield case and the shielded cable are removed.
Figure 19:
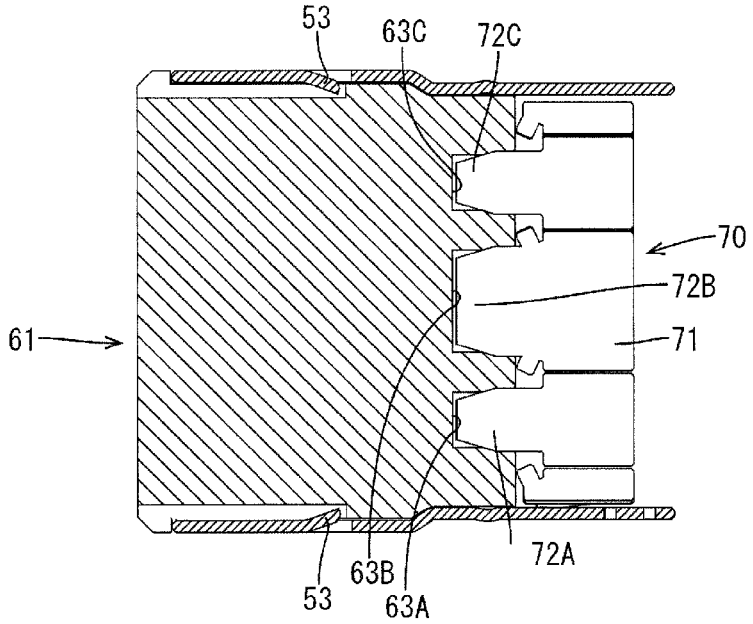
FIG. 19 is a plan view in section at a height of press-fit holes in the state of FIG. 18.

As shown in FIG. 5, a front side of the terminal 20 serves as a terminal connecting portion 21 in the form of a rectangular tube, and a wire connecting portion 23 to be connected to the conductor of the wire 11 to 14 is formed integrally behind the terminal connecting portion 21. A resilient contact piece 22 (see FIG. 14) to be connected to a mating male terminal is provided in the terminal connecting portion 21. The wire connecting portion 23 includes a bottom plate 24 and two barrel pieces 25 extending from side edges of the bottom plate 24. The conductor of each wire 11 to 14 is connected electrically to the wire connecting portion 23, for example, by being soldered or welded to the bottom plate 24.

(Housing 30)

Figure 8:
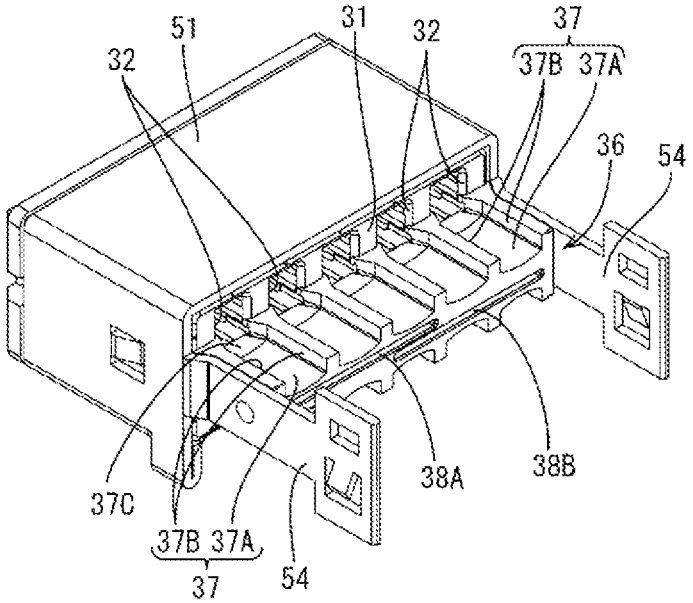
FIG. 8 is a perspective view showing a state where a first shield case is mounted in a housing.
Figure 9:
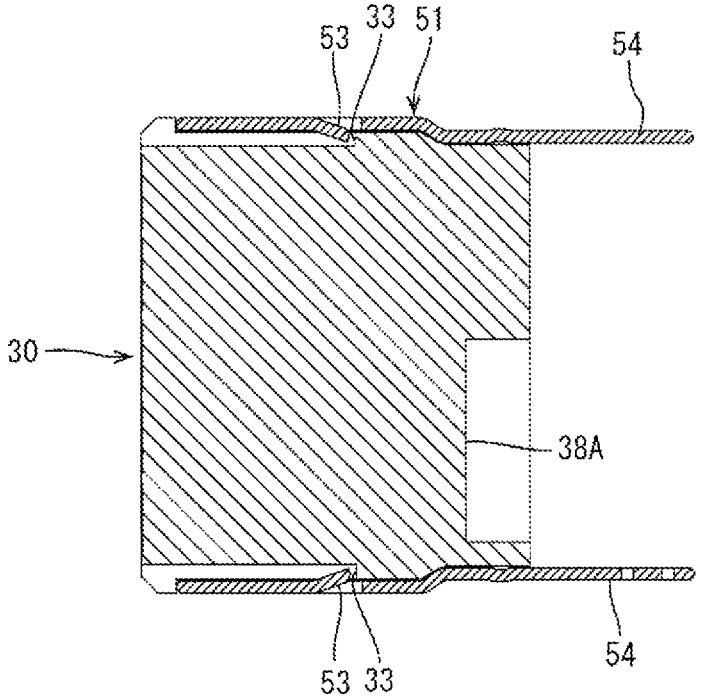
FIG. 9 is a plan view in section at the height of the press-fit holes in the state of FIG. 8.

As shown in FIG. 8, the housing 30 includes a body 31 made of insulating synthetic resin and is configured to accommodate the terminal connecting portions 21 of the respective terminals 20. An extending portion 36 extends behind the body 31 and has a small thickness. The body 31 has a rectangular parallelepiped shape and five cavities 32 for accommodating the terminals 20 are arranged at intervals in the lateral direction in each of two upper and lower stages.

Each cavity 32 has a rectangular cross-section in conformity with the outer peripheral shape of the terminal connecting portion 21 and extends in the front-rear direction according to a length of the terminal connecting portion 21. A front stop wall 34 (see FIG. 14) is formed in a front end part of the cavity 32 for restricting a forward movement of the terminal 20. The front stop wall 34 is formed by narrowing a hole diameter of the cavity 32 in a stepped manner. A resiliently deformable detachment restricting piece for restricting the detachment of the terminal 20 toward a rear side by locking the terminal connecting portion 21 extends in a cantilever manner on an inner wall of the cavity 32.

The extending portion 36 is in the form of a plate extending rearward from a vertically middle part of the rear end of the body 31 and includes, as shown in FIG. 8, a plurality of groove-like placing portions 37 arranged such that the wire connecting portions 23 of the respective terminals 20 can be placed thereon, and press-fit holes 38A, 38B open on the rear end surface of the extending portion 36. The placing portion 37 includes a bottom surface 37A and groove walls 37B standing from both side edges of the bottom surface 37A. The placing portions 37 are formed side by side in the lateral direction according to the number of the terminals 20 on each of the upper and bottom surfaces of the extending portion 36. The bottom surface 37A has an inclined surface 37C slightly curved to be lower at a middle side and inclined such that a tip side becomes lower toward a front side. The groove walls 37B are inclined to narrow the bottom surface 37A toward the front side and are connected to the cavity 32.

The press-fit holes 38A, 38B are formed by recessing the rear end surface of the extending portion 36 to have such a depth that press-fit portions 44 are press-fit. Left and right press-fit holes 38A, 38B are provided to have slightly different heights and arranged to vertically overlap at the middle side.

(Partition 40)

Figure 10:
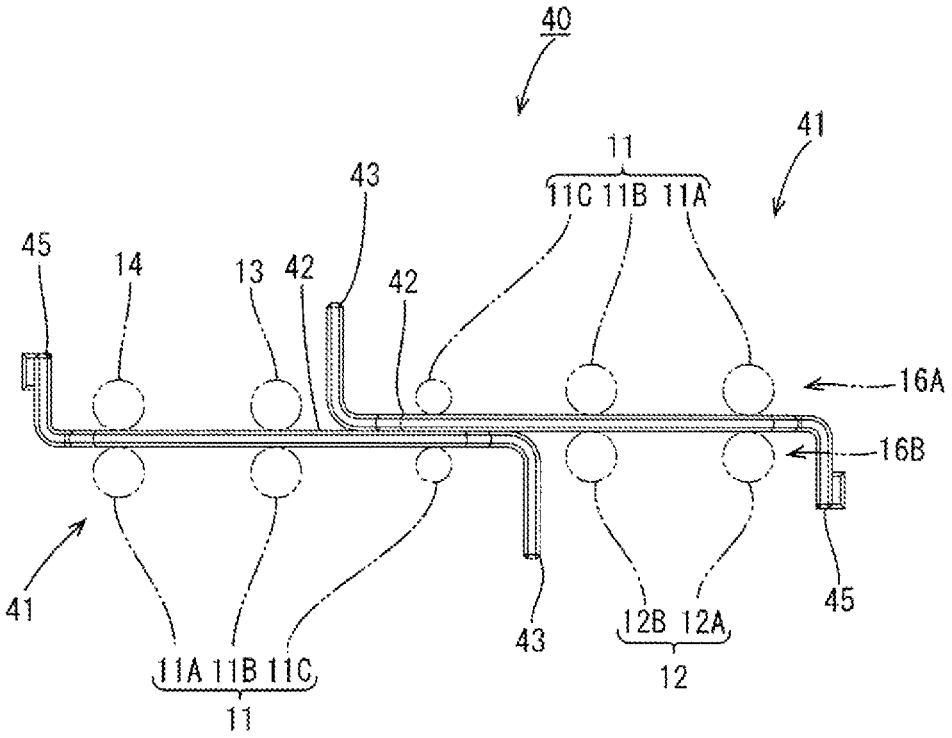
FIG. 10 is a front view showing a partition wall portion.
Figure 11:
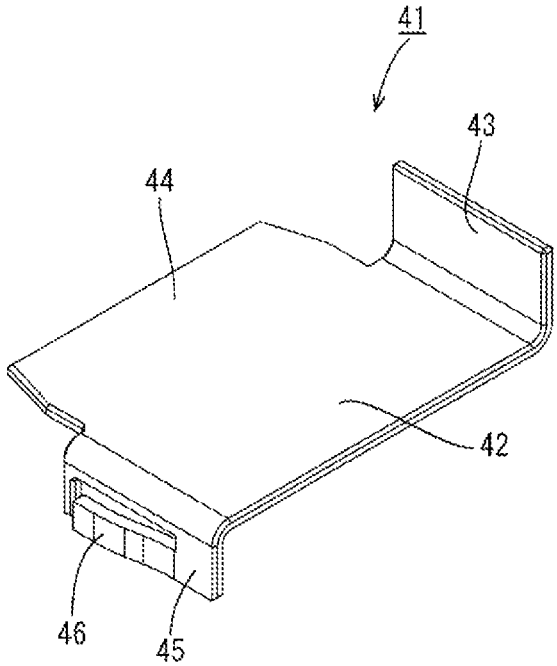
FIG. 11 is a perspective view showing the partition wall portion.
Figure 12:
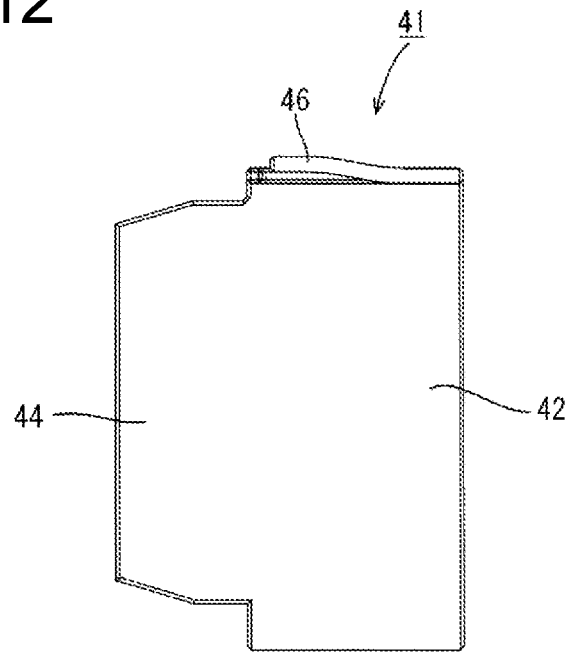
FIG. 12 is a plan view showing the partition wall portion.
Figure 13:
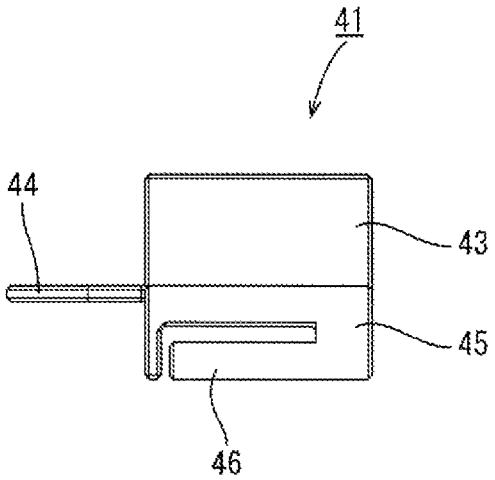
FIG. 13 is a side view showing the partition wall portion.

As shown in FIGS. 10 and 11, the partition 40 is configured by connecting two partition plates 41, 41. The two partition plates 41, 41 are identically shaped, and are formed by applying punching and bending to a metal plate material, such as aluminum, aluminum alloy, copper or copper alloy. Each partition plate 41, 41 includes a rectangular plate-like first wall 42 extending in the lateral direction, a second wall 43 standing from one side edge of the first wall 42, a case connecting portion 45 standing toward a side opposite to the second wall 43 from the other side edge of the first wall 42 and the press-fitting portion 44 in front of and continuous and flush with the first wall 42 and to be press-fit into the press-fit hole 38A, 38B.

The second wall 43 has a rectangular shape and is formed over the entire length of the side edge of the first wall 42. A height of the second wall 43 is set such that the second wall 43 is in contact with an inner wall of a second shield case 57. The case connecting portion 45 includes a resilient piece 46 configured to resiliently contact the inner wall of the second shield case 57. The resilient piece 46 is cantilevered forward with a rear end as a base end. The press-fitting portion 44 is formed over substantially the entire width of the first wall 42 and is narrowed toward a tip side by having both side edge parts of the tip side cut obliquely.

The two partition plates 41, 41 are connected laterally at a predetermined position with the front and back sides of one partition plate 41 set opposite to those of the other, and the second walls 43 located at an inner side and the case connecting portions 45 are located at outer sides, thereby configuring the partition 40 in which the wires 11 to 14 arranged in the lateral direction are partitioned by the second walls 43. First wires 11A to 11C are arranged at intervals in the wider one of left and right areas partitioned by the second wall 43, and the second wires 12A, 12B or the power supply wire 13 and the ground wire 14 are arranged at intervals in the narrower area. The upper and lower wire rows 16A, 16B are arranged such that the respective first wires 11A to 11C are at positions diagonal to each other (areas on distant sides). Note that the second wall 43 is not arranged between the respective first wires 11A to 11C, between the second wires 12A, 12B and between the power supply wire 13 and the ground wire 14 (not arranged for each individual wire).

(Shield Case 50)

Figure 1:
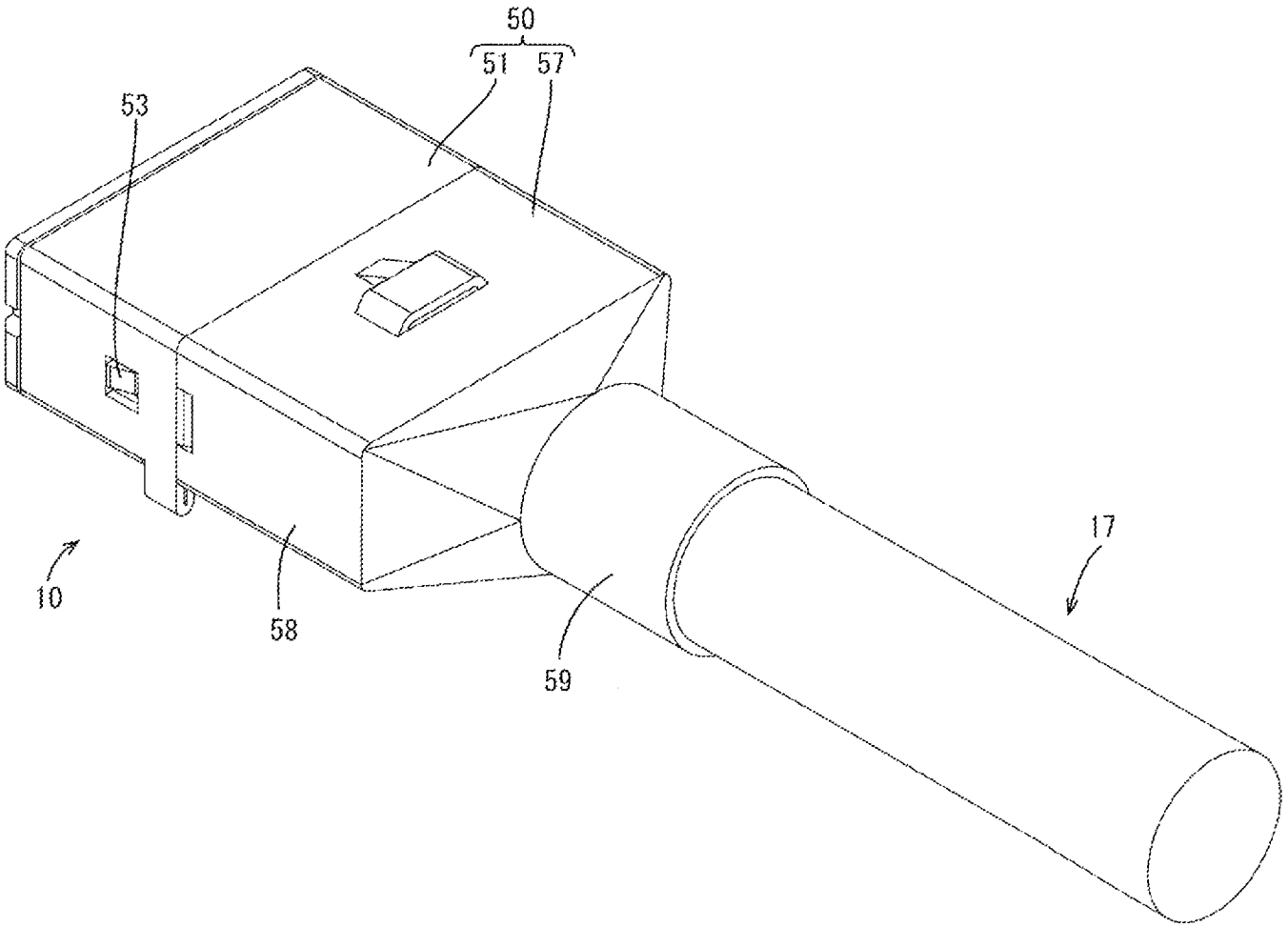
FIG. 1 is a perspective view showing a communication connector of a first embodiment connected to an end part of a shielded cable.
Figure 2:
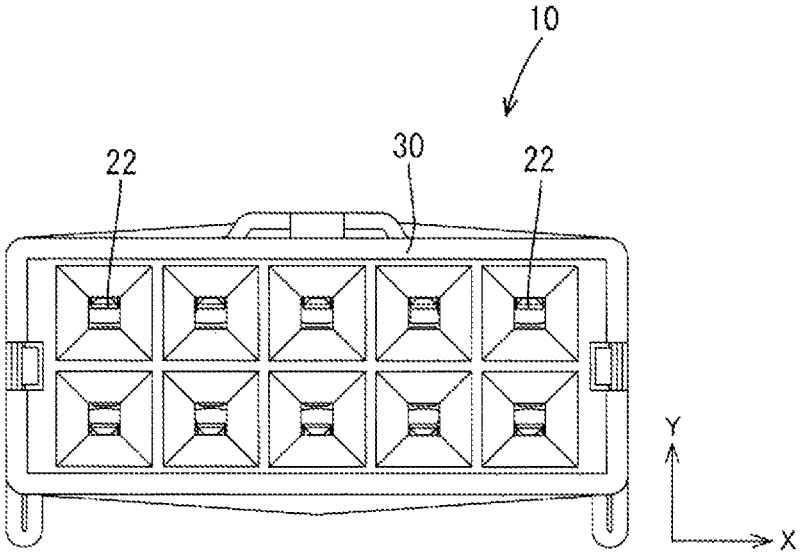
FIG. 2 is a front view showing the communication connector connected to the end part of the shielded cable.

As shown in FIG. 1, the shield case 50 includes a first shield case 51 for covering the body 31 of the housing 30 and a second shield case 57 arranged behind the first shield case 51 for covering the wires 11 to 14. The first shield case 51 is made of metal, such as aluminum or aluminum alloy, and includes, as shown in FIG. 3, a housing surrounding portion 52 in the form of a rectangular tube for surrounding the housing 30 and coupling portions 54 to be connected to the shield case 57. Locked portions 53 formed of resiliently deformable resilient pieces are provided on left and right side surfaces of the housing surrounding portion 52. When the first shield case 51 is fit into the housing 30 from behind the housing 30, the locked portions 53 are locked to locking portions 33 (see FIG. 7) formed by cutting side surfaces of the housing 30. Each coupling portion 54 is a plate extending rearward from the rear end of the side surface of the housing surrounding portion 52 and includes a locking piece 55. The locking piece 55 is resiliently deformable and is connected electrically to the second shield case 57 by contacting an inner surface of the second shield case 57.

The second shield case 57 is made of metal, such as aluminum or aluminum alloy, and includes, as shown in FIG. 1, a box-shaped wire shielding portion 58 open forward and a hollow cylindrical shield connecting portion 59 to be fit externally on the shielded cable 17. The wire shielding portion 58 surrounds all of the wires 11 to 14. The shield connecting portion 59 is connected, for example, to the shield layer folded outside the insulation coating 15 at the end part of the shielded cable 17. The shield connecting portion 59 and the shield layer can be fixed, for example, by welding or crimping.

According to this embodiment, the following functions and effects are exhibited.

According to this embodiment, the wires 11 to 14 are partitioned by the partition 40. Thus, the number of places where the positions of the wires 11A to 11C, 12A, 12B, 13 and 14 are displaced to change the intervals between the wires 11A to 11C, 12A, 12B, 13 and 14 a large amount is reduced. Thus, a reduction of communication quality such as due to signal reflection at impedance changing points of the wires can be suppressed.

Further, the of wires 11 to 14 include the USB 3.0 first wires 11A to 11C and the USB 2.0 second wires 12A, 12B, and the partition 40 is arranged between the first wires 11A to 11C and the second wires 12A and 12B. Thus, a reduction of communication quality between the first wires 11A to 11C and the second wires 12A and 12B can be suppressed.

Furthermore, the wires 11 to 14 include the USB 3.0 first wires 11A to 11C and the power supply wire 13 connected to the power supply, and the partition 40 is arranged between the first wires 11A to 11C and the power supply wire 13. Thus, a reduction of communication quality between the first wires 11A to 11C and the power supply wire 13 can be suppressed.

Further, the wires 11 to 14 include the USB 3.0 first wires 11A to 11C, and the partition 40 is arranged between the first wires 11A to 11C. Thus, a reduction of communication quality between the first wires 11A to 11C can be suppressed.

Furthermore, wire rows 16A, 16B are formed by arranging the plurality of wires 11 to 14 in parallel, and the partition wall 40 is arranged between the wire rows 16A, 16B. Thus, a reduction of communication quality between the wire rows 16A, 16B can be suppressed.

Further, the partition 40 includes the first walls 42 arranged between the plurality of wire rows 16A, 16B and the second walls 43 standing on the first wall 42 and arranged between the plurality of wires 11 to 14 in each wire row 16A, 16B. Thus, a reduction of communication quality between the wires 11 to 14 in a plural stages can be suppressed.

Furthermore, each wire row 16A, 16B includes the USB 3.0 first wires 11A to 11C. The first wires 11A to 11C are partitioned by the second wall portion 43 in one of the wire rows 16A, 16B are arranged at positions diagonal to the first wires 11A to 11C in the different wire row 16B, 16A.

By diagonally arranging the first wires 11A to 11C of the different wire rows 16A, 16B in this way, the first wires 11A to 11C of the different wire rows 16A, 16B are arranged at distant positions. Thus, a reduction of communication quality between the first wires 11A to 11C of the different wire rows 16A, 16B can be further suppressed.

Further, since the partition 40 is formed by connecting the plurality of partition plates 41, 41 in each of which the second wall 43 stands on the first wall 42, the partition 40 is formed easily.

Furthermore, since the partition 40 is fixed by being press-fitted into the housing 30, the partition 40 can be fixed reliably to the housing 30 by a simple configuration.

Further, since the housing 30 includes the cavities 32 for accommodating the respective terminals 20, even if the communication connector 10 is installed in the vehicle, troubles such as due to the vibration of the vehicle can be suppressed.

A second embodiment of the invention is described with reference to FIGS. 14 to 25. The same components as in the first embodiment are denoted by the same reference signs and not described.

Although the partition 40 is formed from two partition plates 41, 41 in the first embodiment, a partition 70 formed by applying punching and bending to one metal plate material is used in a communication connector of the second embodiment.

Figure 20:
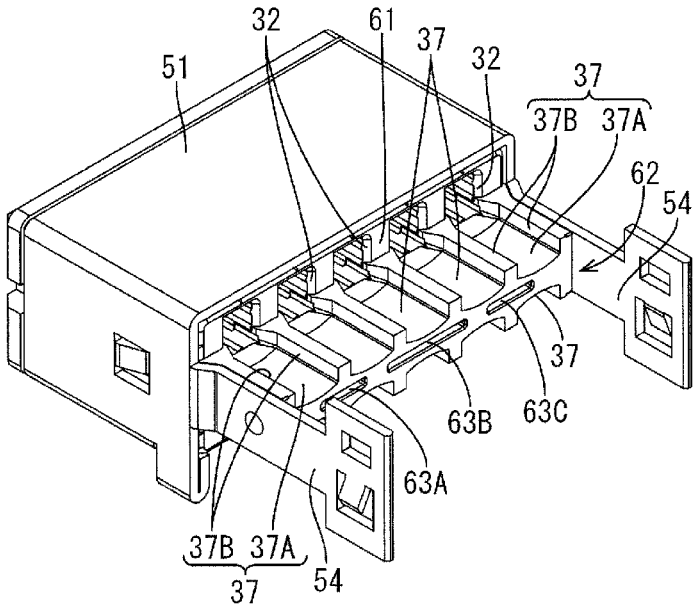
FIG. 20 is a perspective view showing a state where a first shield case is mounted in a housing.
Figure 21:
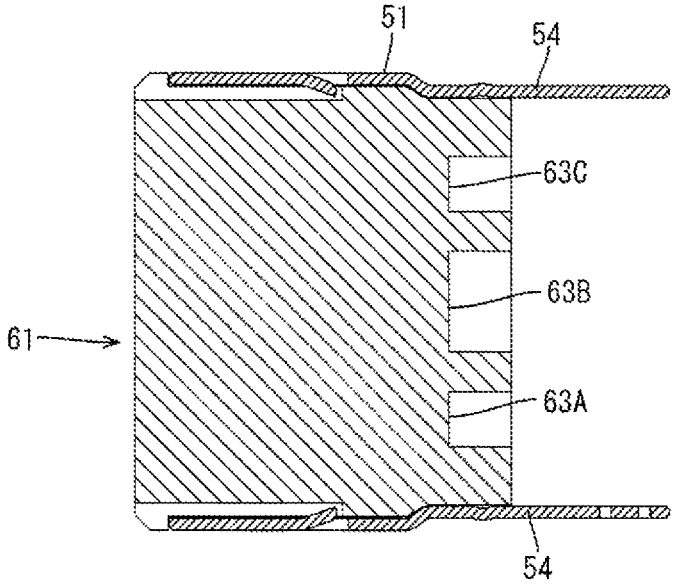
FIG. 21 is a plan view in section at the height of the press-fit holes in the state of FIG. 20.

As shown in FIGS. 20 and 21, an extending portion 62 extending rearward while having a smaller thickness than a housing 61 is formed with groove-like placing portions 37 arranged on the upper and lower surfaces of the extending portion 62 such that wire connecting portions 23 of respective terminals 20 can be placed thereon. Three press-fit holes 63A to 63C are formed at intervals on the rear end surface of the extending portion 62, with the middle press-fit hole 62B being wider than the other two press-fit holes 63A, 63C.

Figure 22:
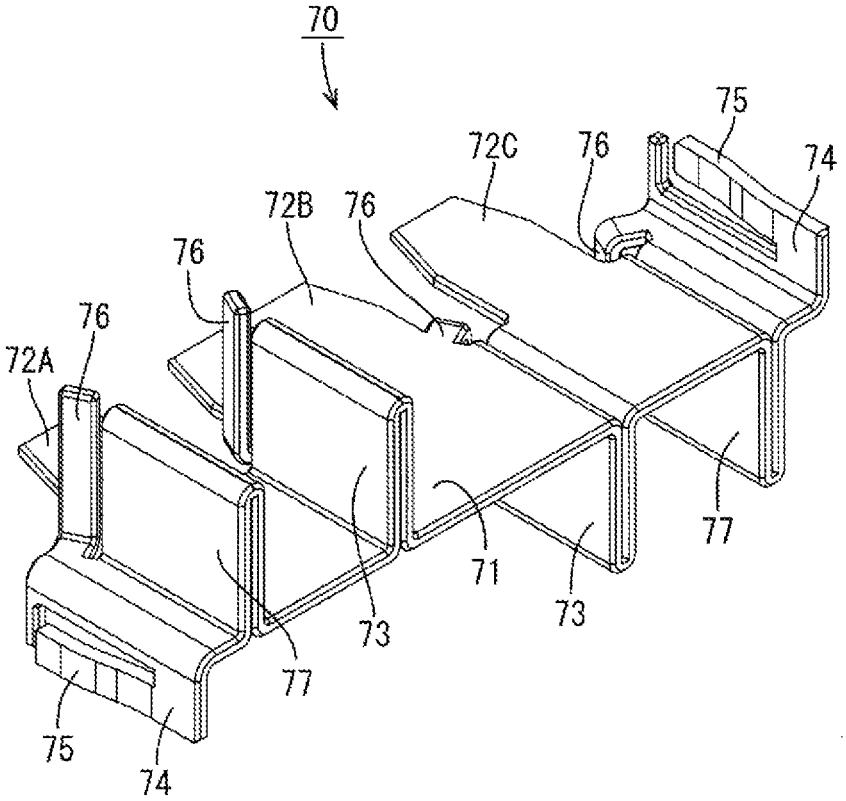
FIG. 22 is a perspective view showing a partition wall portion.
Figure 23:
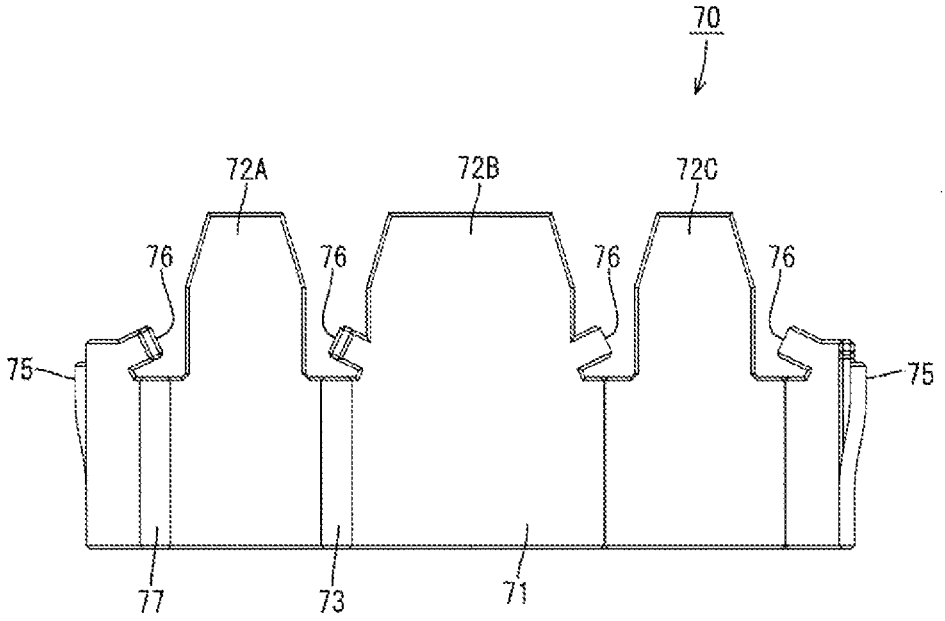
FIG. 23 is a plan view showing the partition wall portion.
Figure 24:
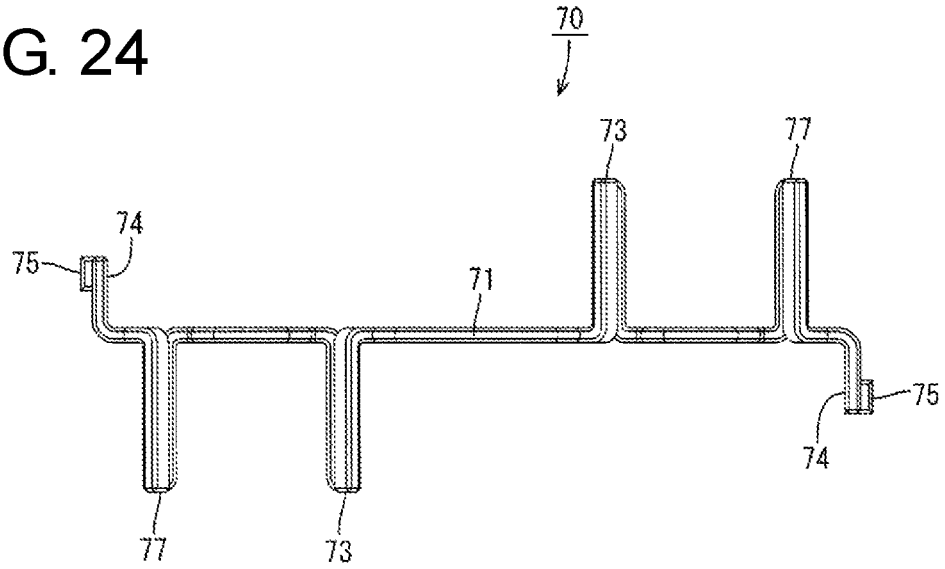
FIG. 24 is a front view showing the partition wall portion.
Figure 25:
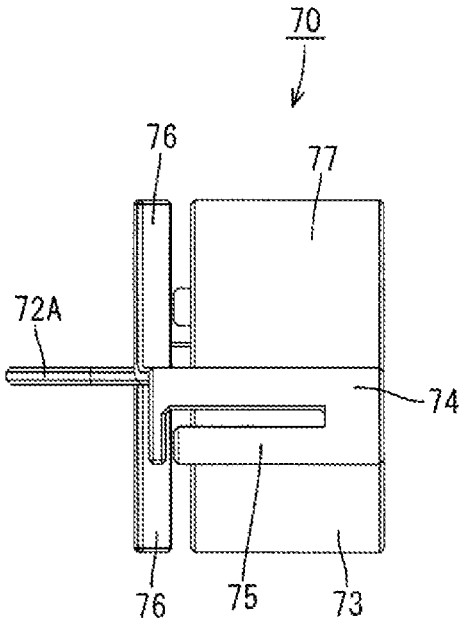
FIG. 25 is a side view showing the partition wall portion.

As shown in FIG. 22, the partition 70 includes a first wall 71 extending in a lateral direction, three press-fitting portions 72A to 72C to be press-fit into the press-fit holes 63A to 63C and second wall portions 73, third wall portions 77 and case connecting portions 74 standing from the first wall 71. The first wall 71 is formed over the entire width of the housing 61 and connected behind the extending portion 62. The second walls 73 stand up and down from the first wall 71, the upper second wall 73 is arranged on one side lateral to a middle part and the lower second wall 73 is arranged on the other side lateral to the middle part while being spaced apart. The second walls 73 are formed by folding the metal plate material.

Two second wires 12A, 12B are inserted between the second wall 73 and the third wall 77 on an upper side and three first wires 11A to 11C are inserted at intervals at a right side of the upper second wall 73. A power supply wire 13 and a ground wire 14 are inserted between the second wall 73 and the third wall 77 on a lower side and the first wires 11A to 11C are inserted at intervals at a left side of the second wall 73. Wire guides 76 for guiding the wires 11 to 14 to predetermined paths are formed in front of the second walls 73 and the third walls 77. The wire guides 76 extend in directions to widen a spacing between the second wall 73 and the third wall 77. The wires 11 to 14 can be guided while being protected by the wire guides 76 by having the outer peripheries thereof supported by the wire guides 76.

The middle press-fitting portion 72B is wider than the other two press-fitting portions 72A, 72C, and tip parts of the press-fitting portions 72A to 72C are slightly narrowed by having side edges of the tip parts obliquely cut. The partition 70 is fixed to the housing 61 by press-fitting the press-fitting portions 72A to 72C into the press-fit holes 63A to 63C (see FIG. 19).

Two of the case connecting portions 74 are provided on both side edge parts of the first wall 71 and stand in mutually opposite directions from the first wall 71, and resiliently deformable resilient contact pieces 75 are cantilevered forward with rear sides as base ends.

A third embodiment of the invention is described with reference to FIGS. 26 to 31.

Figure 26:
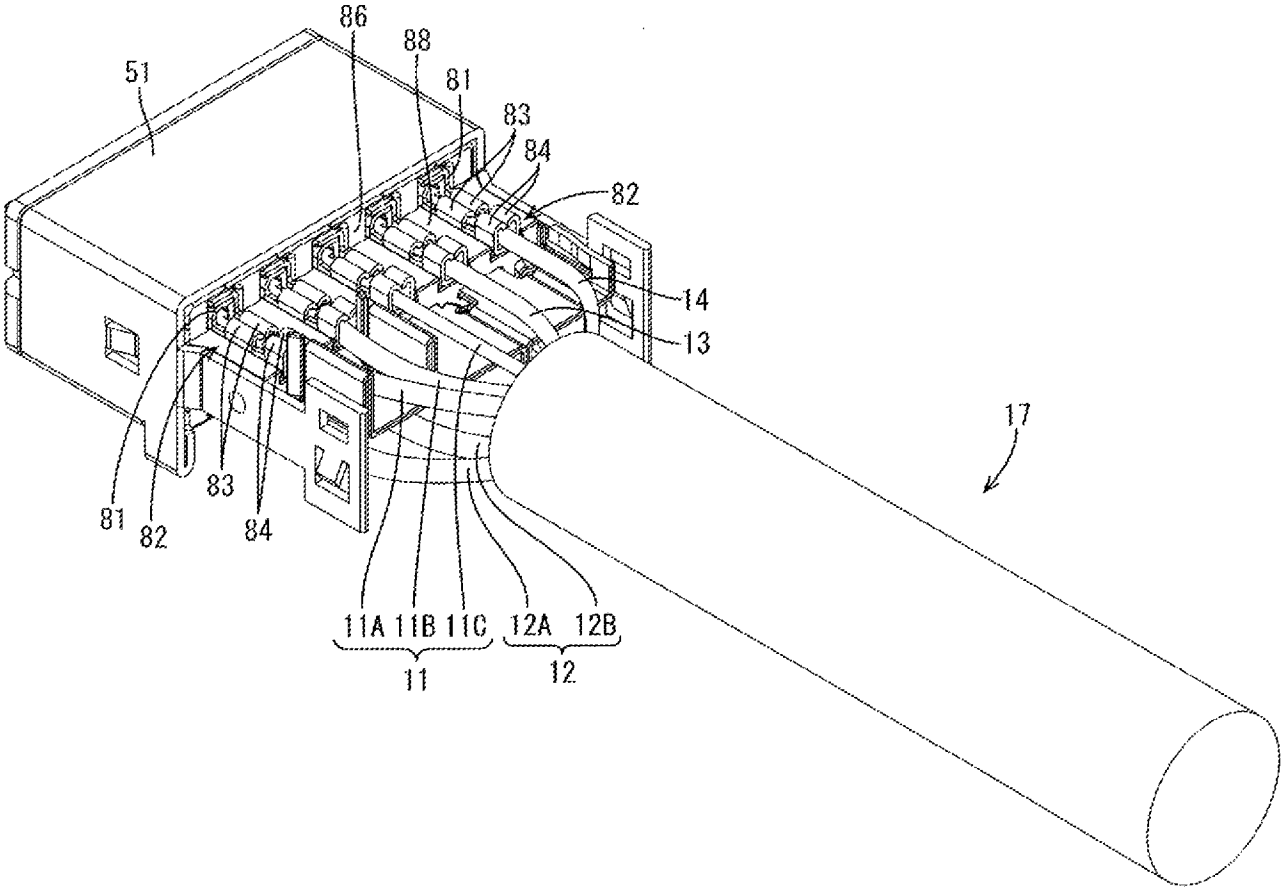
FIG. 26 is a perspective view showing a communication connector of a third embodiment connected to an end part of a shielded cable in a state where a second shield case is removed.
Figure 27:
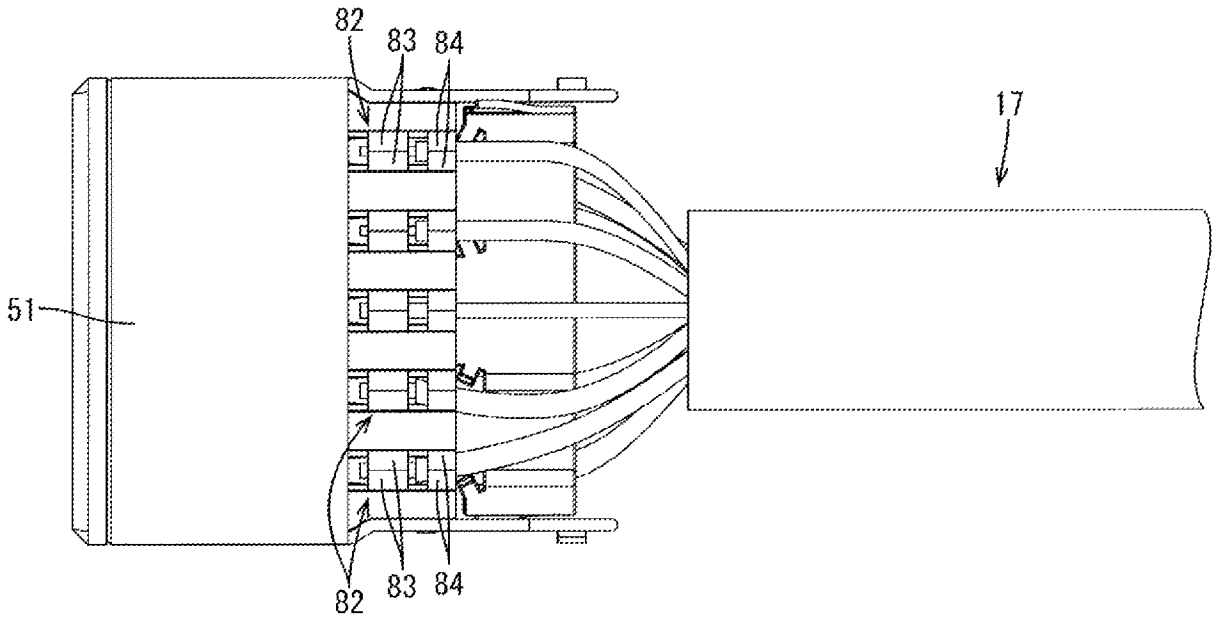
FIG. 27 is a plan view showing the communication connector connected to the end part of the shielded cable in the state where the second shield case is removed.
Figure 28:
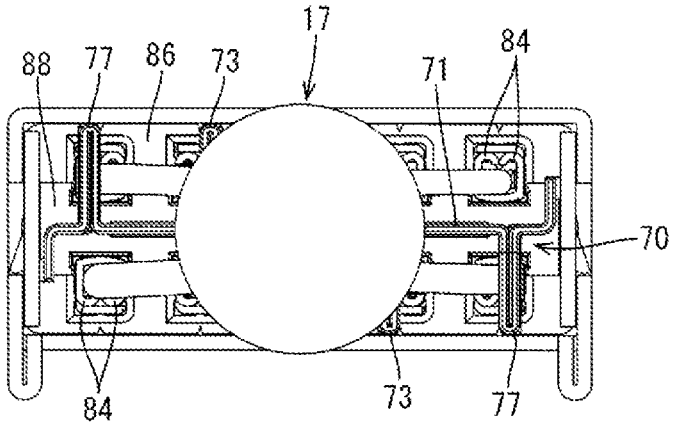
FIG. 28 is a back view showing the communication connector connected to the end part of the shielded cable in the state where the second shield case is removed.

In the third embodiment, wire connecting portions 82 of terminals 81 are crimped and connected to wires 11 to 14, as shown in FIG. 26. The same components as in the above embodiments are denoted by the same reference signs and not described.

The wire connecting portion 82 of the terminal 81 includes two wire barrel portions 83 and two insulation barrel portions 84 standing from both side edges of a bottom plate. The wire barrel portions 83 are crimped to a conductor exposed at an end part of the wire 11 to 14, and the insulation barrel portions 84 are crimped to hold an insulation coating of the wire 11 to 14.

Figure 29:
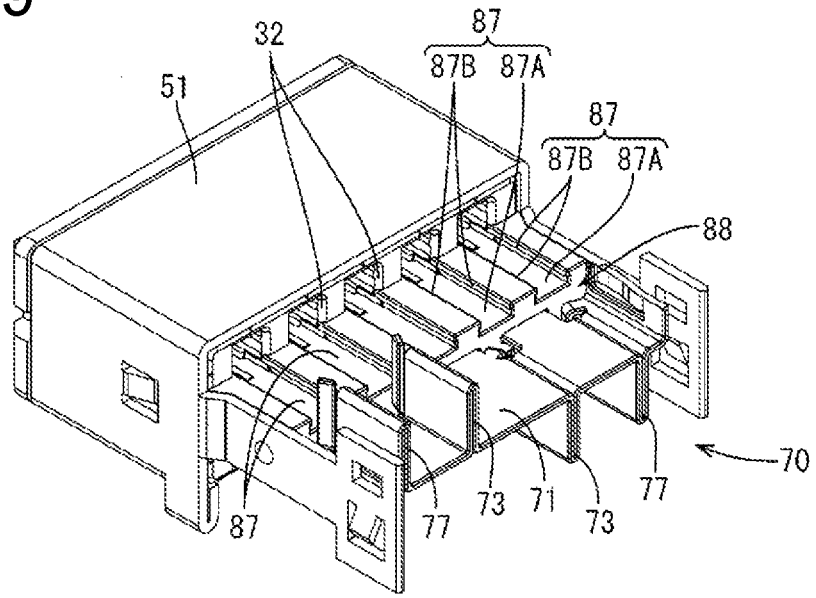
FIG. 29 is a perspective view showing the communication connector in a state where the second shield case, the shielded cable and terminals are removed.
Figure 30:
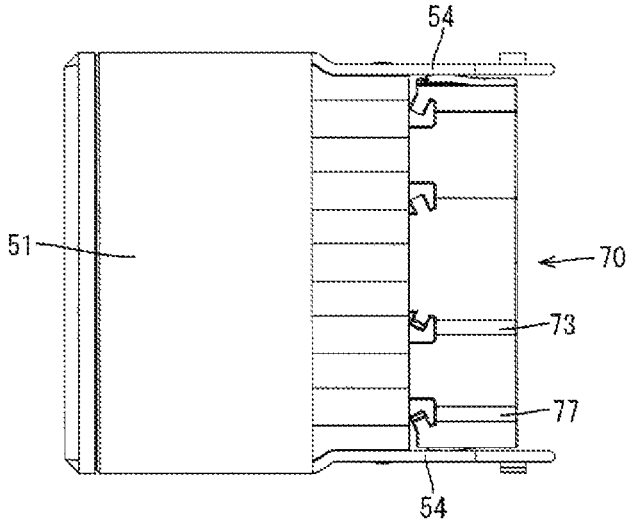
FIG. 30 is a plan view showing the communication connector in the state where the second shield case, the shielded cable and the terminals are removed.
Figure 31:
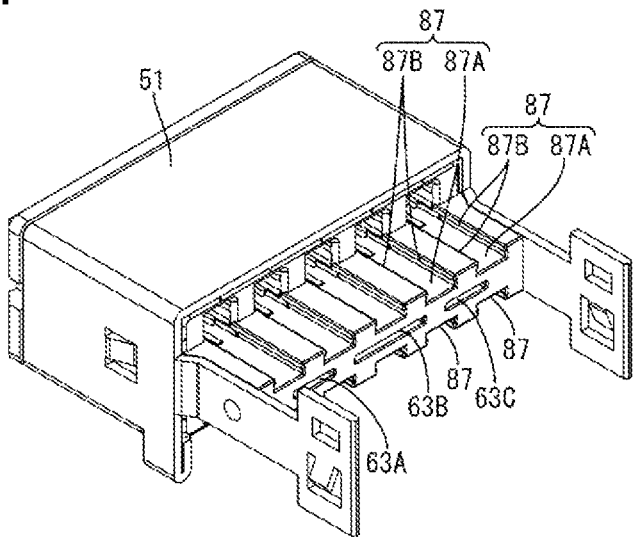
FIG. 31 is a perspective view showing a state where a first shield case is mounted in a housing.
Figure 32:
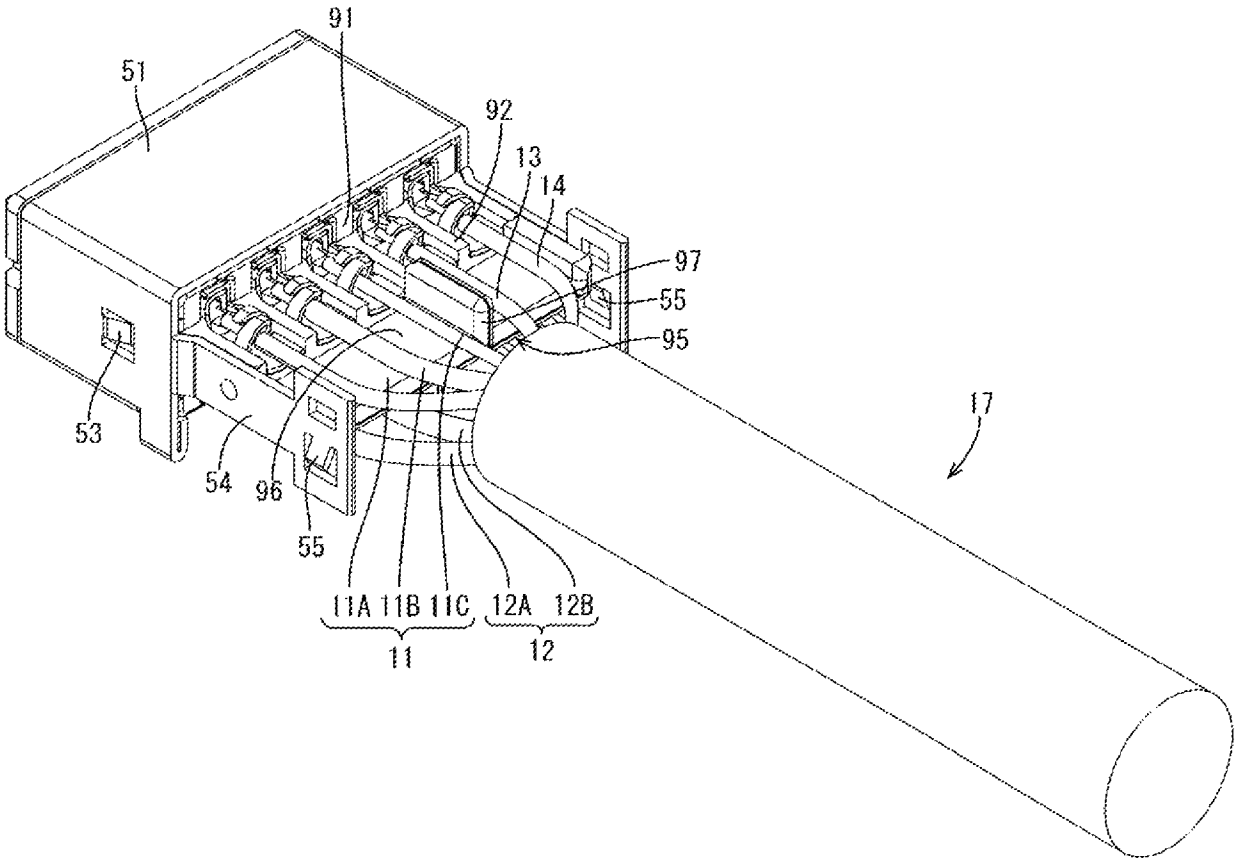
FIG. 32 is a perspective view showing a communication connector of a fourth embodiment connected to an end part of a shielded cable in a state where a second shield case is removed.
Figure 33:
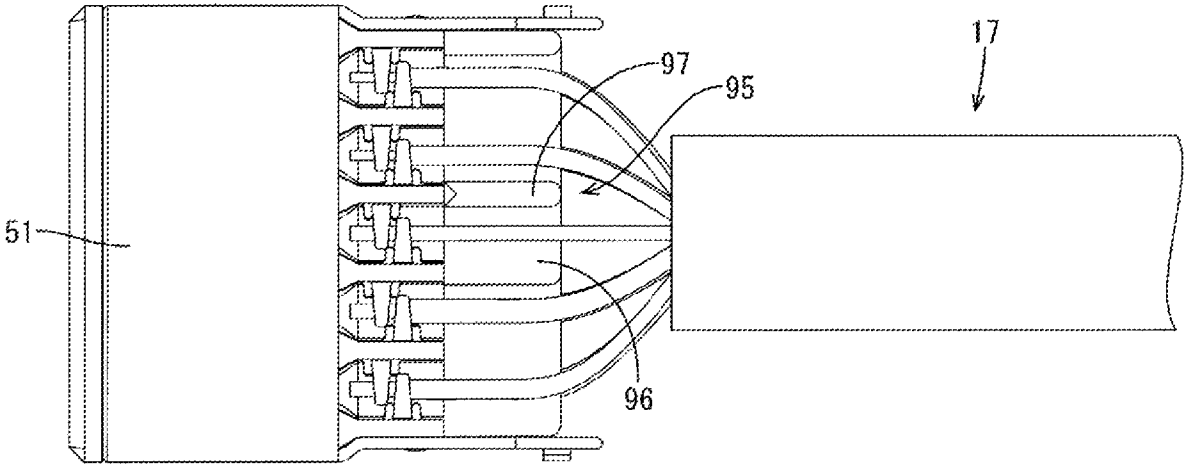
FIG. 33 is a plan view showing the communication connector connected to the end part of the shielded cable in the state where the second shield case is removed.
Figure 34:
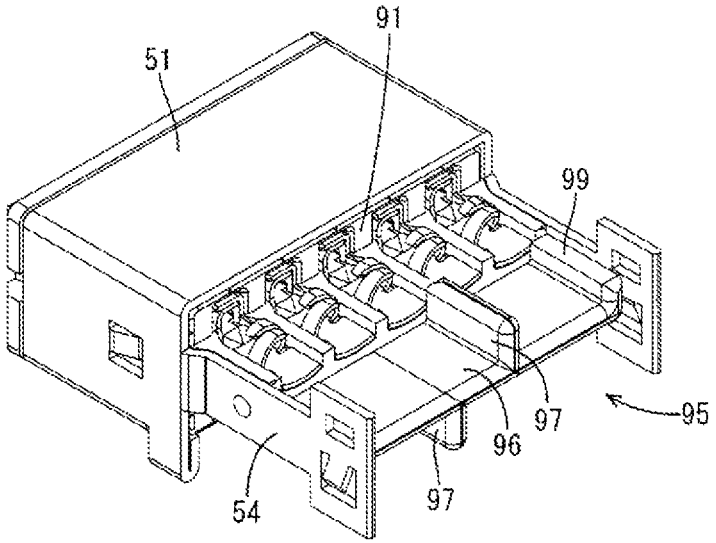
FIG. 34 is a perspective view showing the communication connector in a state where the second shield case and the shielded cable are removed.
Figure 35:
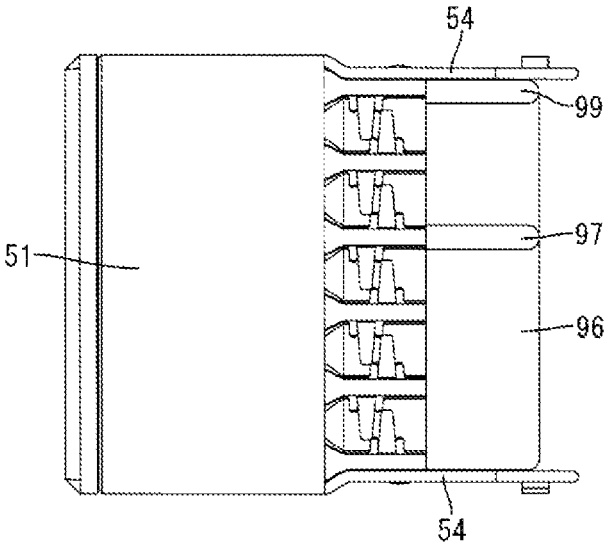
FIG. 35 is a plan view showing the communication connector in the state where the second shield case and the shielded cable are removed.
Figure 36:
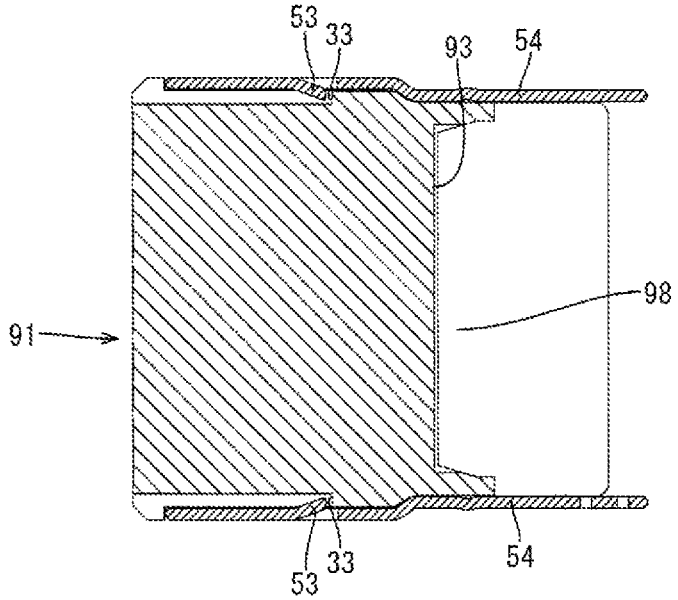
FIG. 36 is a plan view in section at a height of a press-fit hole in the state of FIG. 35.

An extending portion 88 extends rearward while having a smaller thickness than a housing 86. The extending portion 88 is formed with a plurality of placing portions 87 arranged on the upper and lower surfaces of the extending portion 88 such that the wire connecting portions 82 are placed thereon, as shown in FIG. 29. Each placing portion 87 is formed into a groove shape corresponding to a width of the wire connecting portion 82 and includes a bottom surface 87A and groove walls 87B standing from both side edges of the bottom surface 87A, and the wire connecting portion 82 is fit into the placing portion 87.

A fourth embodiment of the invention is described with reference to FIGS. 32 to 42.

The communication connector of the fourth embodiment has a partition 95 formed of conductive resin. The same components as in the above embodiments are denoted by the same reference signs and not described.

Figure 37:
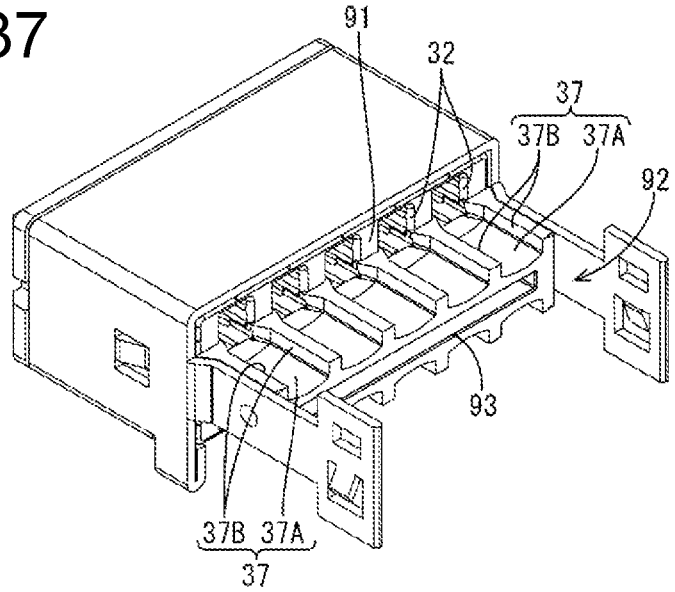
FIG. 37 is a perspective view showing a state where a first shield case is mounted in a housing.
Figure 38:
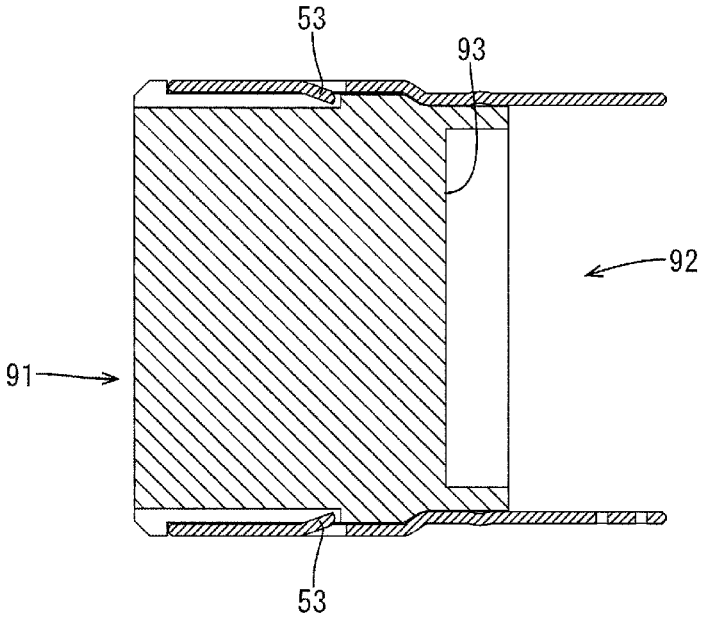
FIG. 38 is a plan view in section at the height of the press-fit hole in the state of FIG. 37.

As shown in FIGS. 37 and 38, the connector of the fourth embodiment has a housing 91 and an extending portion 92 extends rearward from the rear end surface of the housing 91 while having a smaller thickness than the housing 91. The extending portion 92 is recessed to a predetermined depth over substantially the entire width of the housing 91, thereby forming a press-fit hole 93. A vertical hole dimension of the press-fit hole 93 is larger than those of the press-fit holes in the above embodiments.

Figure 39:
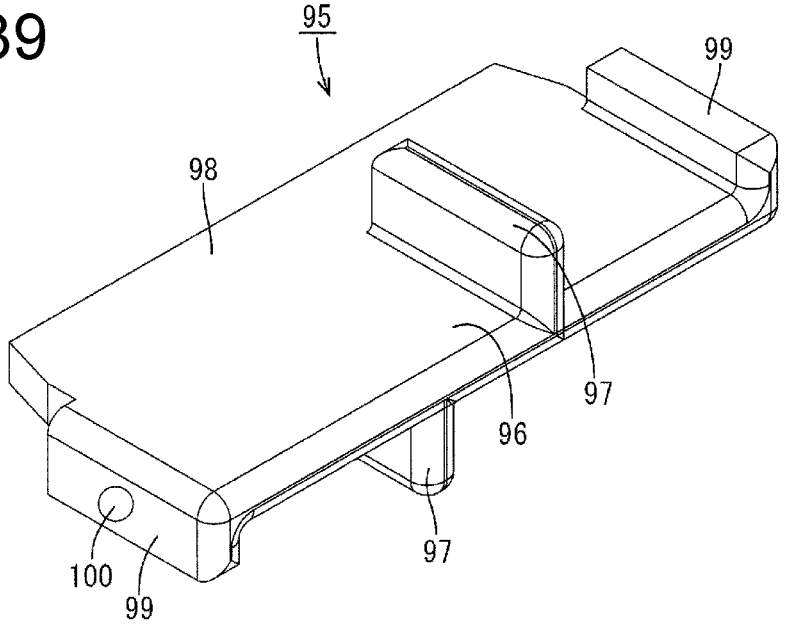
FIG. 39 is a perspective view showing a partition wall portion.
Figure 40:
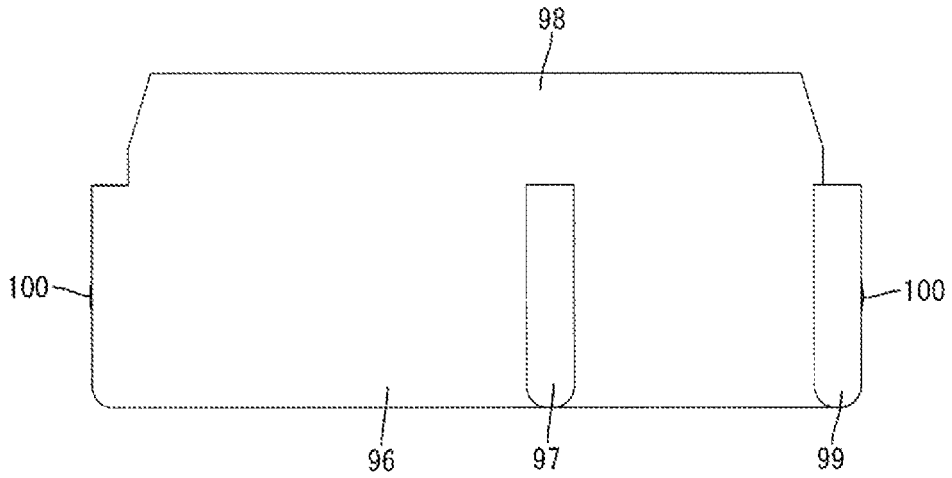
FIG. 40 is a plan view showing the partition wall portion.
Figure 41:
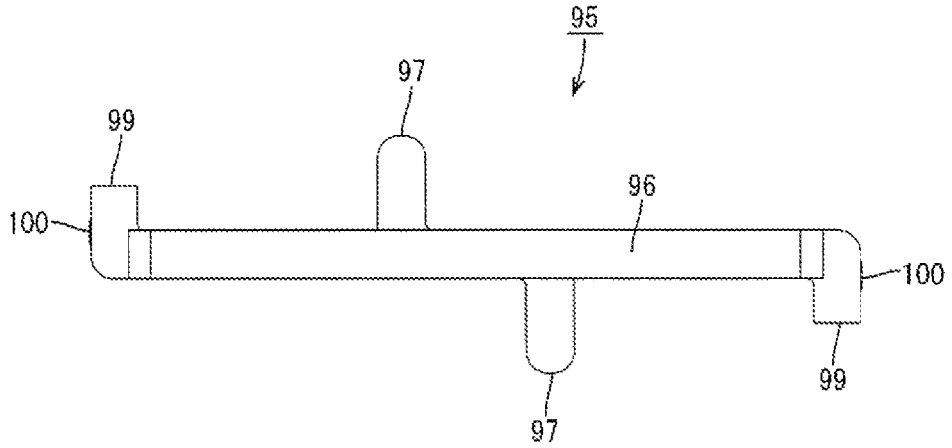
FIG. 41 is a front view showing the partition wall portion.
Figure 42:
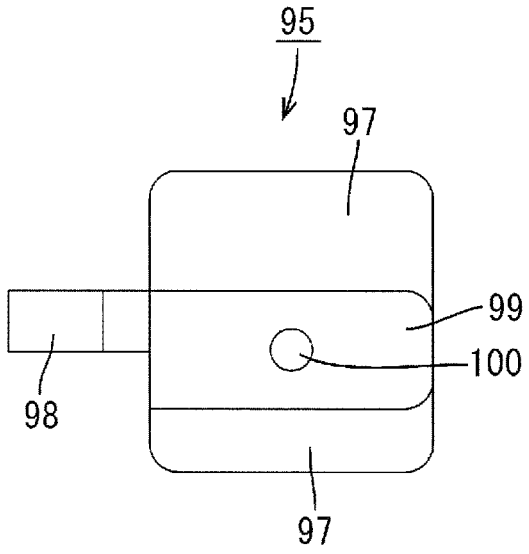
FIG. 42 is a side view showing the partition wall portion.

As shown in FIG. 39, the partition 95 includes a first wall 96 extending in a lateral direction while having a length corresponding to the width of the housing 91, second walls 97 standing on the first wall 96 to partition a plurality of wires 11 to 14, a press-fitting portion 98 to be press-fit into the press-fit hole 93 and case connecting portions 99 to be connected to a second shield case 57. Upper and lower second wall portions 97 are provided, with the upper second wall 97 being arranged closer to one case connecting portion 99 than a laterally middle part and the lower second wall 97 being arranged closer to the other case connecting portion 99 than the laterally middle part.

The press-fitting portion 98 is connected in front of and flush with the first wall 96 and tip sides of left and right side edges are cut obliquely. The case connecting portions 99 stand in mutually opposite directions from both side edge parts of the first wall 96. Semispherical contact portions 100 project on outer surfaces of the case connecting portions 99 and are configured to come into contact with inner surfaces of the second shield case 57.

Various known conductive resins can be used for forming the partition 95, and conductive plastic having conductivity derived from a polymer structure or conductive plastic having conductivity by adding an inorganic conductor to non-conductive plastic may be used.

According to the fourth embodiment, since the partition 95 is made of conductive resin, it is possible to shield between the wires while easily shaping the partition wall portion 95 by characteristics of the resin.

The present invention is not limited to the above described and illustrated embodiments. For example, the following embodiments are also included in the technical scope of the present invention.

Although the partition 40, 70, 95 includes the first walls 42, 71, 96 and the second walls 43, 73, 97, only one of the first walls 42, 71, 96 or the second walls 43, 73, 97 may be provided.

Although the first wires 11 in the different wire rows 16A, 16B are arranged diagonally, the first wires 11 may not be arranged diagonally.

The number of the wires 11 to 14 is not limited to the above number. Further, places where the wires 11 to 14 are partitioned by the partition 40 can be set arbitrarily according to the number of the wires, the types of the wires and the like.

LIST OF REFERENCE SIGNS

10: communication connector
11A to 11C (11): first wire
12A, 12B (12): second wire
13: power supply wire
15: ground wire
16A, 16B: wire row
17: shielded cable
20, 81: terminal
30, 61, 86, 91: housing
32: cavity
36, 62, 88, 92: extending portion
37, 87: placing portion
38A, 38B, 63A to 63C, 93: press-fit hole
40, 70, 95: partition wall
41, 41: two partition plates
42, 71, 96: first wall
43, 73, 97: second wall
44, 72A to 72C, 98: press-fitting portion
45, 74, 99: case connecting portion
50: shield case

The invention claimed is:

1. A communication connector, comprising:

a housing having first and second spaced apart sidewalls and top and bottom walls extending between the first and second spaced apart sidewalls, and a plurality of cavities arranged between the first and second spaced apart sidewalls and extending in forward to rearward directions;

a plurality of wires for transmitting communication signals;

a plurality of terminals connected to the plurality of wires, each of the plurality of terminals being accommodated in a corresponding one of the plurality of cavities with the plurality of wires extending rearward from the housing; and a partition for partitioning the plurality of wires into a plurality of wire rows, each of the plurality of wire rows including at least one of the plurality of wires, the partition arranged at a position rearward of the plurality of terminals, the partition comprising:

a first partition plate having a first wall extending in a lateral direction between first and second side edges and normal to the forward and backward directions, a second wall projecting from the first side edge in a first projecting direction normal to the first wall, and a case connecting wall projecting from the second side edge in a second projecting direction normal to the first wall and opposite the first projecting direction; and a second partition plate having a first wall extending in the lateral direction between first and second side edges and normal to the forward and backward directions, a second wall projecting from the first side edge in the second projecting direction, and a case connecting wall projecting from the second side edge in the first projecting direction, wherein:

the first and second partition plates are arranged to partially overlap so that the second wall of the first partition plate is arranged between the second wall of the second partition plate and the case connecting wall of the second plate in the lateral direction, and the second wall of the second partition plate is arranged between the second wall of the first partition plate and the case connecting wall of the first partition plate in the lateral direction to define channels on opposite sides of the second wall of the first partition plate and the second wall of the second partition plate in which the plurality of wire rows are accommodated.

2. The communication connector of claim 1, wherein:

the plurality of wires include a USB 3.0 first wire and a USB 2.0 second wire; and the second wall of the first partition plate or the second wall of the second partition plate is arranged between the first wire and the second wire.

3. The communication connector of claim 1, wherein:

the plurality of wires include a USB 3.0 first wire and a power supply wire connected to a power supply; and the second wall of the first partition plate or the second wall of the second partition plate is arranged between the first wire and the power supply wire.

4. The communication connector of claim 1, wherein:

the plurality of wires include a plurality of USB 3.0 first wires; and the second wall of the first partition plate or the second wall of the second partition plate is arranged between the plurality of first wires.

5. The communication connector of claim 1, wherein the partition is fixed by being press-fit into the housing.

6. The communication connector of claim 1, wherein:

the communication connector is installed in a vehicle.

7. The communication connector of claim 1, wherein a plurality of USB 3.0 first wires are provided in each of the plurality of wire rows, and the first wires of one of the plurality of wire rows are arranged at positions diagonal to the first wires of another one of the plurality of wire rows.

* * * * *